US006647580B2

(12) United States Patent
Krasuski et al.

(10) Patent No.: US 6,647,580 B2
(45) Date of Patent: Nov. 18, 2003

(54) MAINTENANCE DEVICE FOR FOLDING/ INSERTION MACHINE

(75) Inventors: Marek Krasuski, Fontenay aux Roses (FR); Patrice Montigny, Fontenay le Fleury (FR)

(73) Assignee: Neopost Industrie, Bagneux (FR)

( * ) Notice: Subject to any disclaimer, the term of this patent is extended or adjusted under 35 U.S.C. 154(b) by 58 days.

(21) Appl. No.: 09/993,760

(22) Filed: Nov. 27, 2001

(65) Prior Publication Data

US 2002/0066469 A1 Jun. 6, 2002

(30) Foreign Application Priority Data

Dec. 1, 2000 (FR) ..... 00 15559

(51) Int. Cl.[7] ..... B08B 13/00
(52) U.S. Cl. ..... 15/104.93; 15/210.1
(58) Field of Search ..... 15/104.93, 104.94, 15/209.1, 210.1

(56) References Cited

U.S. PATENT DOCUMENTS 4,891,265 A * 1/1990 Samagalsky
5,153,964 A 10/1992 Gelardi et al.
5,854,962 A 12/1998 Boockholdt et al.
6,243,908 B1 * 6/2001 Battle

FOREIGN PATENT DOCUMENTS

DE 44 33 707 A1 A1 3/1995
WO WO 92/04990 A1 4/1992

* cited by examiner

*Primary Examiner*—Randall E. Chin
(74) *Attorney, Agent, or Firm*—Sughrue Mion, PLLC

(57) ABSTRACT

This invention relates to a device for maintaining the take-up rollers of document feeders of a folding/insertion machine, comprising a sheet imbibed with a liquid maintenance product and intended to be entrained inside the machine by the take-up rollers, this self-cleaning sheet comprising retaining means for stopping its advance in the machine and allowing its withdrawal once the take-up rollers of the feeder are stopped.

4 Claims, 4 Drawing Sheets

MAINTENANCE DEVICE FOR FOLDING/ INSERTION MACHINE

FIELD OF THE INVENTION

The present invention relates exclusively to the field of mail processing and more particularly to a system for maintenance of the take-up rollers of an automatic document feeder for a folding/insertion machine.

BACKGROUND OF THE INVENTION

Regular maintenance of a folding/insertion machine is essential for guaranteeing long-term functioning thereof. More particularly, maintenance of the take-up rollers for feeding documents, envelopes, inserts, is primordial for the drive, folding and insertion of these various pieces to be optimum without damaging or soiling them despite a drive speed which is nonetheless high.

In effect, in a mail processing assembly which incorporates a folding/insertion machine at the outlet of a laser or ink jet printer, the take-up rollers may be subject to premature wear and be fouled fairly rapidly (in principal they are rubber-coated) insofar as, contrary to the functioning of a standard printer, different types of articles (documents, envelopes, inserts) of various characteristics (gsm's, formats, materials) may be used.

This results in numerous drawbacks, such as false departures of documents, defects in selection (multiple selections for example), jammings or askew foldings.

It is an object of the present invention to overcome the drawbacks set forth hereinabove, by providing a maintenance device for periodically cleaning the take-up rollers so as to guarantee an improvement in the feed of the different pieces processed, a reduction in the risks of jamming and a preservation of the cleanness and the physical characteristics of the take-up rollers.

SUMMARY OF THE INVENTION

This object is achieved by a device for maintaining the take-up rollers of the document feeders in a folding/insertion machine, characterized in that it comprises a sheet imbibed with a liquid maintenance product and intended to be entrained inside said machine by said take-up rollers, said self-cleaning sheet comprising retaining means for stopping its advance in said machine and for allowing it to be withdrawn once said take-up rollers of the feeder are stopped.

With this device which eliminates manual cleaning, the present risks run by users resulting from the use of specific cleaning products are considerably reduced. In addition, the use of an automatic procedure through the user interface of the machine enables this maintenance operation to be systematized, thus prolonging the life of the machine. Finally, the use of a maintenance product whose efficiency is lesser, as it is standard, reduces the danger of inhalation of toxic vapours.

Said retaining means comprise a retaining rod disposed perpendicularly with respect to a direction of introduction of said self-cleaning sheet, and advantageously fixed at the level of a transverse edge of said self-cleaning sheet. This self-cleaning sheet is preferably of A4 format.

The present invention also relates to the process of maintenance associated with this device, in which said maintenance device is firstly introduced in the take-up rollers of a first feeder to be cleaned, by its transverse edge not provided with retaining means, then said retaining means are returned into abutment against a front edge of the feeder, and, finally, said take-up rollers are driven in rotation by general drive means of the machine until said rollers slip, this resulting from the stop of the advance of said self-cleaning sheet inside the machine, provoked by said retaining means.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
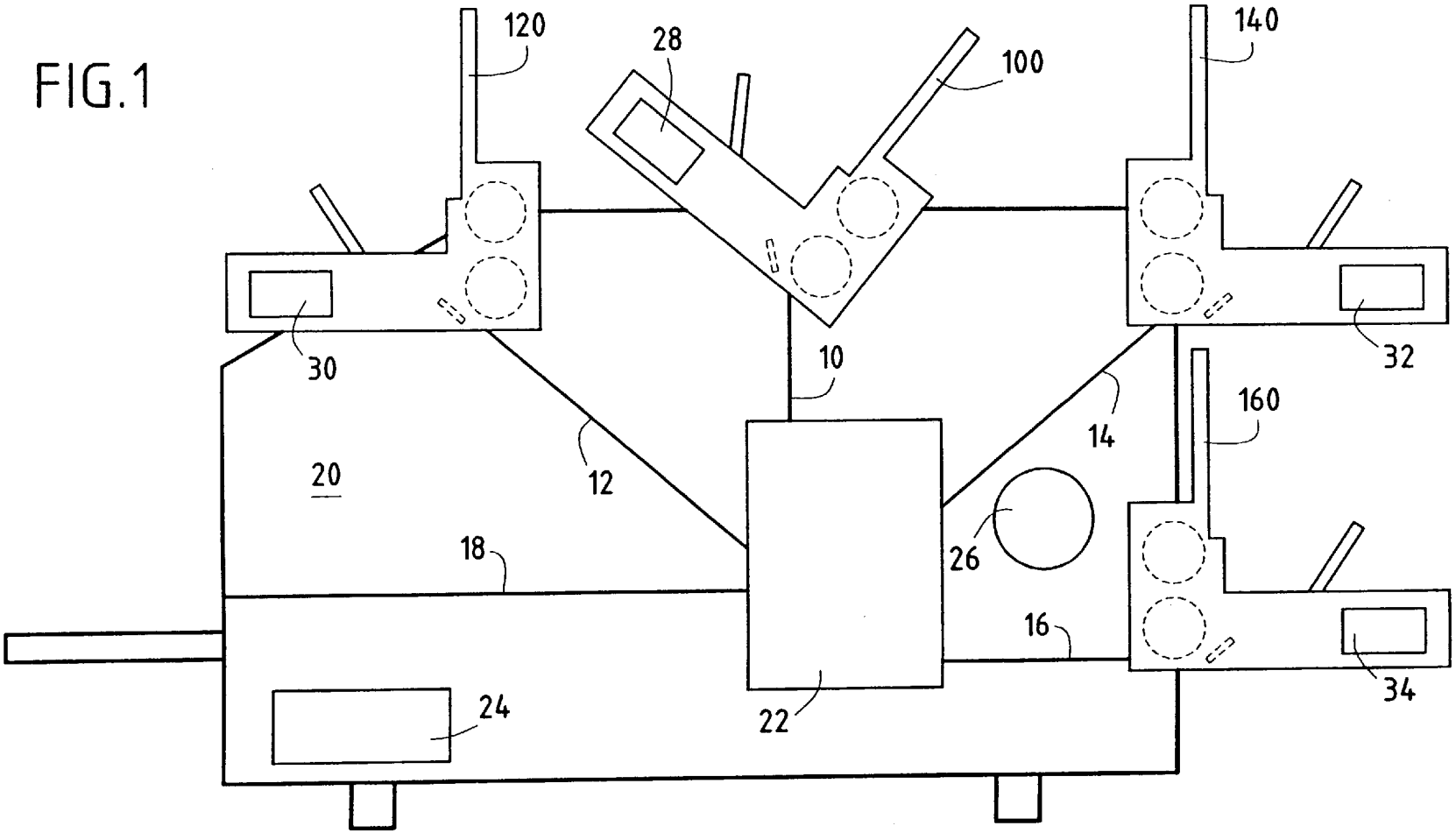
FIG. 1 schematically shows a general view of a folding/insertion machine.

Referring now to the drawings, FIG. 1 very generally illustrates the architecture of a conventional folding/insertion machine. This type of architecture is described in greater detail in applicants' U.S. Pat. Nos. 5,507,129 and 6,016,638, for example.

It will therefore simply be recalled here that such a machine comprises for example a document inlet 10 located at the base of a principal document feeder 100, an empty envelope inlet 12 located at the base of a secondary envelope feeder 120, a first inlet 14 for advertizing inserts or reply envelopes located at the base of a first auxiliary feeder 140, possibly a second inlet 16 for advertizing inserts or reply envelopes located at the base of a second auxiliary feeder 160, and an outlet 18 for filled and closed envelopes. These different structural elements are formed on a machine chassis advantageously in two articulated parts 20.

The empty envelopes are loaded by packets in the feeder 120. Similarly, the documents, advertizing inserts or reply envelopes are likewise introduced by packets in the other feeders 100, 140, 160, respectively. These different types of mailpieces feed a functional folding/insertion module 22. The envelopes filled with the documents and/or advertizing inserts (and/or reply envelopes) and closed, are then available at the outlet 18.

A control circuit 24 defines the different commands to be applied to a motor 26 for generally controlling the machine during a complete folding and insertion cycle, in liaison with interface circuits 28, 30, 32, 34 peculiar to the principal feeder 100, the secondary feeder 120 and the auxiliary feeders 140, 160, respectively.

Figure 2:
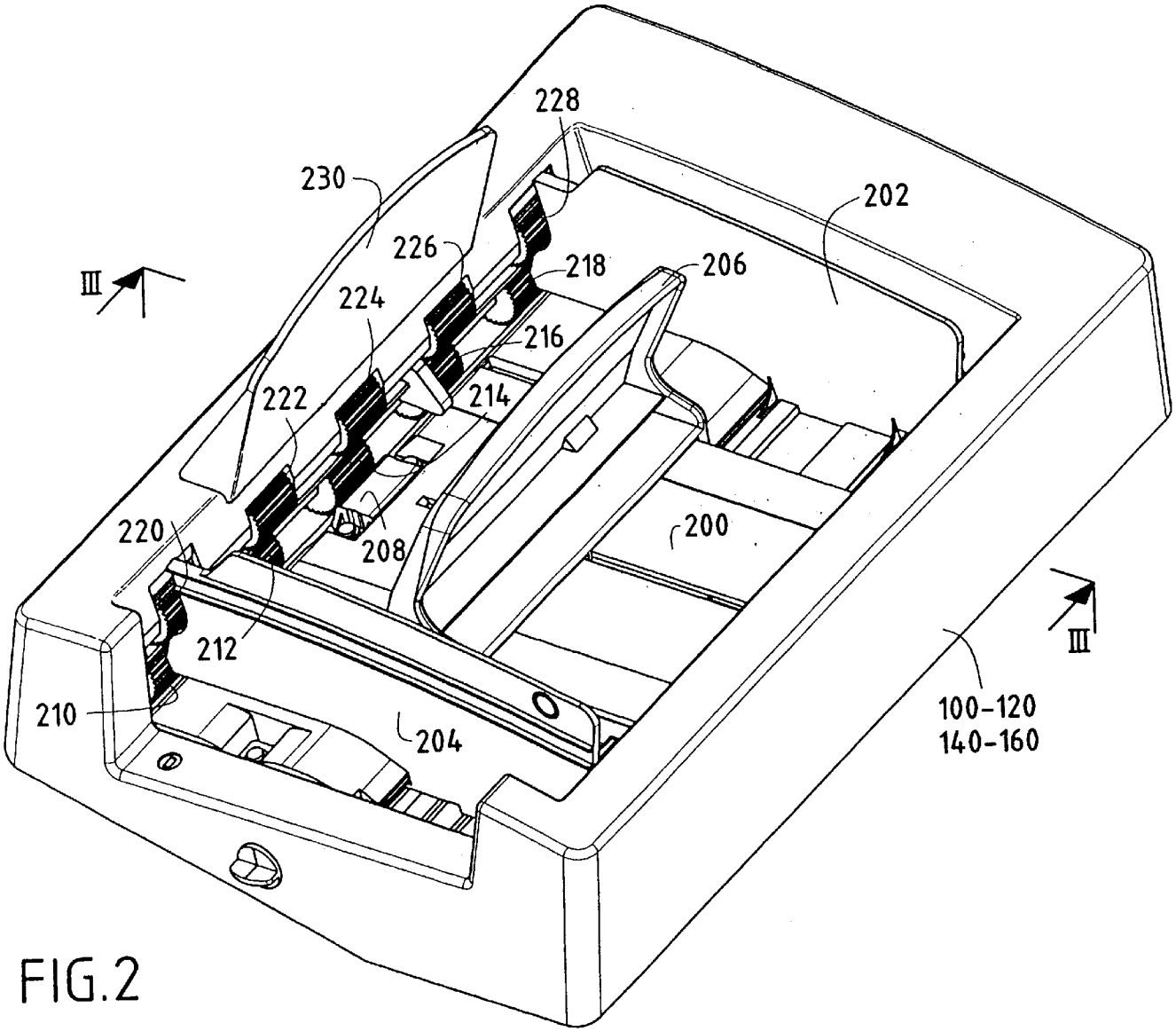
FIG. 2 shows an example of an automatic document feeder used in the machine of FIG. 1.
Figure 3:
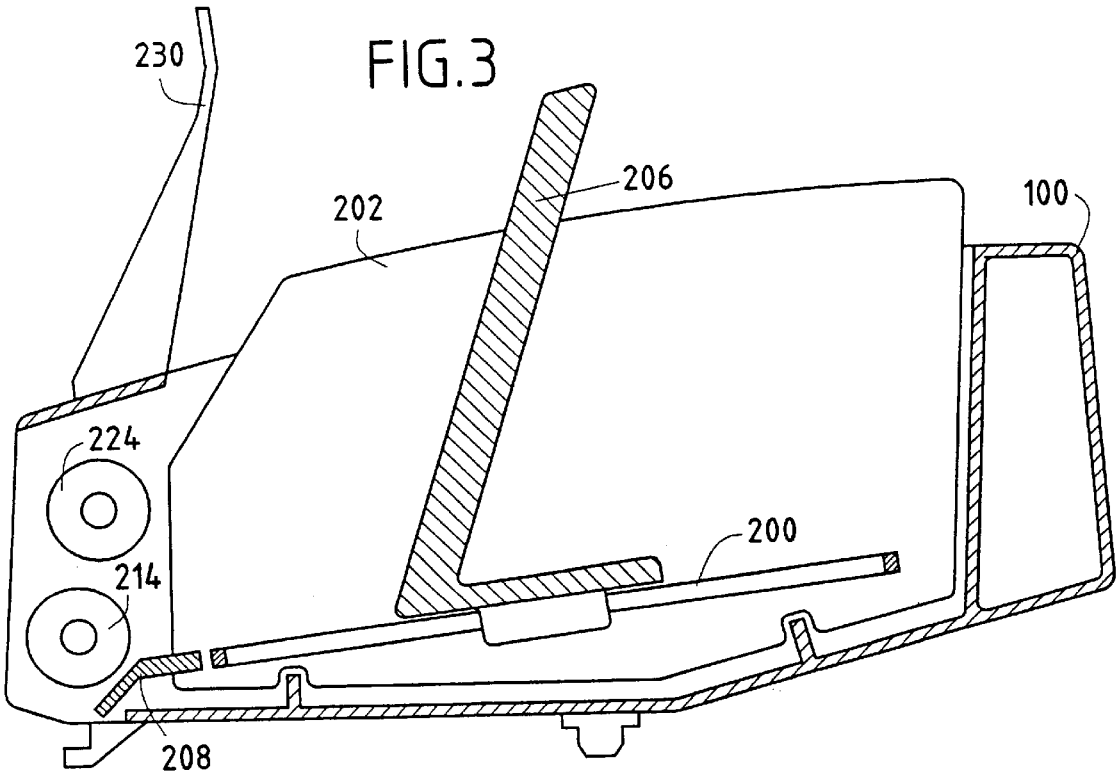
FIG. 3 is a view along plane III—III of FIG. 2.

FIGS. 2 and 3 show an embodiment of an automatic feeder particularly suitable for the afore-mentioned machine.

This feeder, which is advantageously made in a chassis of rigid plastics material, conventionally comprises, on a support plate 200, two self-centred lateral border elements 202, 204 (sliding in synchronism by a rack which has not been shown in the drawings), and a mobile rear presser 206. The support plate comprises on a part of its bottom a separator 208 constituted by a shoe covered by a rough coating to ensure separation/selection of the different mailpieces (documents, empty envelopes, advertizing inserts or reply envelopes) extracted from the corresponding feeder. These mailpieces are driven by at least one roller, and preferably a set of five pairs of rollers 210, 212, 214, 216, 218; 220, 222, 224, 226, 228 for taking up mailpieces, driven by the general control motor 26 of the machine, via an assembly of drive pinions (not shown). A front edge 230 forming stop for holding the mailpieces completes this automatic feeder.

Different sensors (not shown) are, of course, provided to ensure correct functioning of the different feeders, in particular in order to detect the presence of the mailpieces (documents, empty envelopes, advertizing inserts or reply envelopes) on the support plates of the feeders or the introduction of these mailpieces in the machine after the selection by the separator.

Conventionally, and up to the present time, the rollers 210–228 have always been cleaned by hand by rubbing with a cloth imbibed with a specific cleaning product. Now, such a cleaning product, particularly in the form of an aerosol, may prove to be particularly harmful for the airways and mucous membranes of the eye. Moreover, it may form an inflammable mixture with air if the ambient temperature reaches high values (typically around 50° C.).

Figure 4:
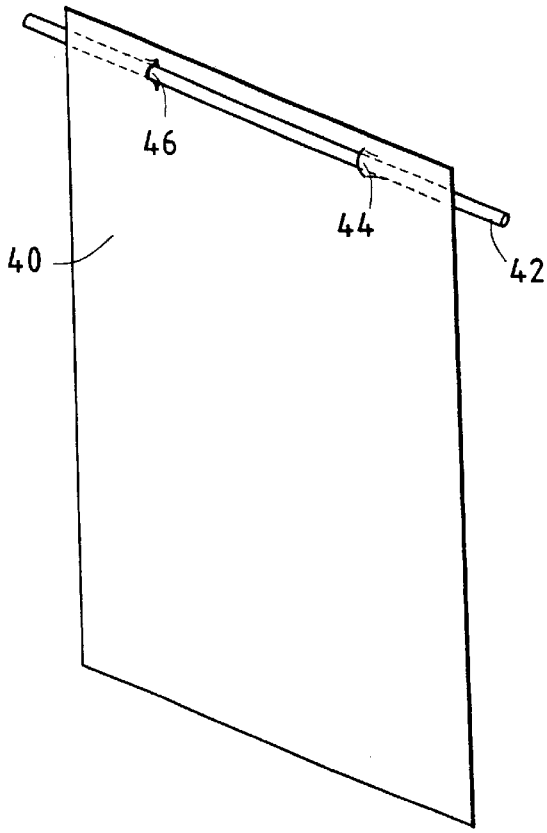
FIG. 4 illustrates a maintenance device according to the present invention.

The invention thus proposes to ensure periodic cleaning of the take-up rollers of the different feeders of the same folding/insertion machine by using a self-cleaning sheet 40 (cf. FIG. 4), advantageously of A4 format, imbibed with an appropriate, generally standard liquid maintenance product, such as the product referenced KF bleu of the French firm CRC Industries, and to which retaining means are fixed, for example a retaining rod 42. This retaining rod, whose length exceeds the width of the sheet 40, can be simply threaded in two holes 44, 46 pierced at the level of a transverse edge of this sheet (it is, of course, also possible to envisage any other fixation, for example by adhesion or stitching).

Figure 5:
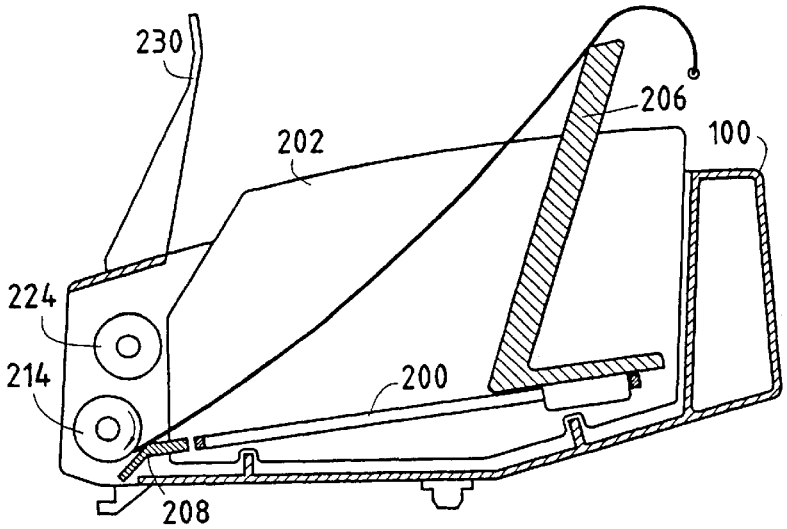
FIGS. 5 to 7 show three successive positions of the maintenance device of FIG. 4.
Figure 6:
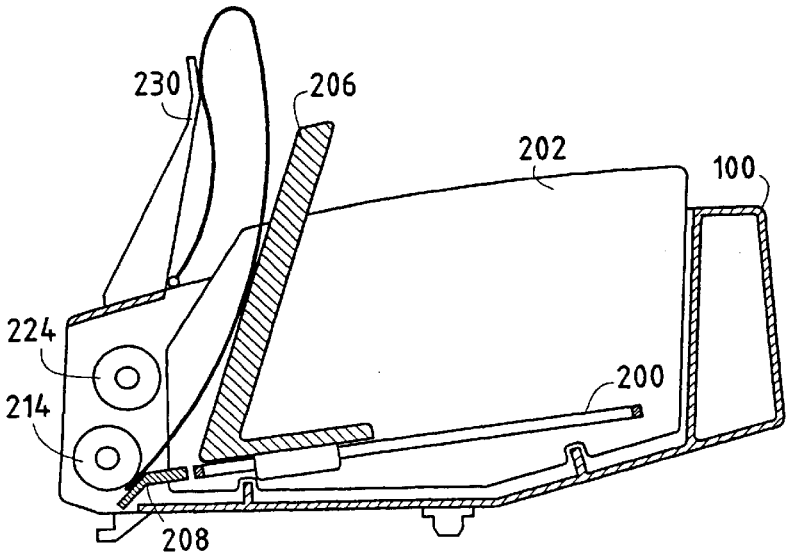
Figure 7:
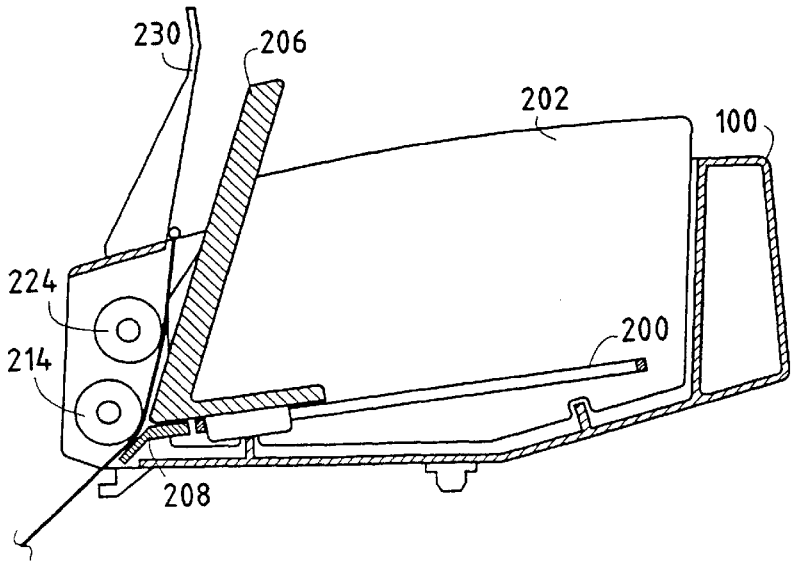

The employment of the maintenance device according to the invention will be explained with reference to FIGS. 5 to 7.

This device is employed during a specific maintenance procedure initiated on the user interface of the machine and which supposes that the feeders to be cleaned are initially empty of mailpieces, the presence detector at the level of each support plate enabling this prior condition to be verified. Once this condition is fulfilled, the user is invited, by a message on the user interface, to place the self-cleaning sheet in position in a first feeder to be cleaned, this operation being carried out in two steps. Firstly (cf. FIG. 5), as for a normal document, this sheet is brought against the lower take-up rollers 210–218 by its first transverse edge opposite the retaining rod 42. Then (FIG. 6), the second edge receiving this retaining rod is returned in abutment against the stop 230 at the front of the feeder. The sheet thus in position, the user is then invited to launch the maintenance process proper, for example, by acting on a "start" button on the user interface. Such selection has the effect of commanding the general motor of the machine 26 which will then activate the lower and upper take-up rollers 210–228 and entrain the sheet 40 towards the interior of the machine in a direction of introduction up to the position defined in FIG. 7 from which, the advance of the sheet being stopped by the retaining rod 42, the rollers start to slip. After several rotations in this state (lasting some seconds) ensuring complete cleaning thereof, the rollers stop automatically and the user is invited to withdraw the self-cleaning sheet by pulling the rod out of the machine. The user can then continue this maintenance process with another feeder of the machine. Once all the feeders are cleaned (it being possible to clean only one specific feeder), the user is invited to return to a normal operational mode of the machine.

What is claimed is:

1. In a folding/insertion machine, a device for maintaining take-up rollers of document feeders, comprising:

a self-cleaning sheet imbibed with a liquid maintenance product and intended to be entrained inside said machine by said take-up rollers, said self-cleaning sheet comprising retaining means for stopping the self-cleaning sheet's advance in said machine and for allowing the self-cleaning sheet to be withdrawn once said take-up rollers of the feeder are stopped.

2. The device for maintaining take-up rollers of document feeders of claim 1, wherein said retaining means comprise a retaining rod disposed perpendicularly with respect to a direction of introduction of said self-cleaning sheet.

3. The device for maintaining take-up rollers of document feeders of claim 2, wherein said retaining rod is fixed at the level of a transverse edge of said self-cleaning sheet.

4. The device for maintaining take-up rollers of document feeders of claim 2, wherein said self-cleaning sheet is of A4 format.

* * * * *